US005794265A

United States Patent [19]

Reich

[11] Patent Number: 5,794,265

[45] **Date of Patent: *Aug. 18, 1998**

[54] GARMENT SLEEVE WITH PROTECTIVE INSERT IN DISTAL END

[75] Inventor: Melvyn Reich, Parsippany, N.J.

[73] Assignee: Masterpiece Apparel, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 781,085

[22] Filed: Jan. 10, 1997

[51] Int. Cl.[6] ..... A41D 27/10

[52] U.S. Cl. ..... 2/125; 2/159

[58] Field of Search ..... 2/125, 162, 170, 2/158, 123, 159, 169

[56] References Cited

U.S. PATENT DOCUMENTS

| | | | |
|---|---|---|---|
| 1,296,966 | 3/1919 | Kaufman | 2/158 X |
| 2,136,879 | 11/1938 | Haber et al. | 2/162 X |
| 2,675,554 | 4/1954 | Gertz | 2/158 X |
| 4,531,241 | 7/1985 | Berger | 2/162 X |
| 4,756,027 | 7/1988 | Buenos et al. | 2/158 X |
| 4,860,386 | 8/1989 | Martin | 2/158 X |
| 4,924,529 | 5/1990 | Grilliot et al. | 2/123 |
| 4,980,929 | 1/1991 | Long | 2/158 X |
| 5,073,988 | 12/1991 | Lewis et al. | 2/162 |
| 5,117,507 | 6/1992 | Long | 2/158 |
| 5,308,275 | 5/1994 | Kombleuth | 2/158 X |
| 5,516,321 | 5/1996 | Kombleuth | 2/158 X |

*Primary Examiner*—C. D. Crowder
*Assistant Examiner*—Shirra L. Jenkins

[57] ABSTRACT

A garment sleeve of relatively long length with an open distal end and an opposite proximate end secured to the garment contains a hollow flexible article of relatively short length and having first and second opposite ends. The article has a relatively small thumb receiving hole intermediate its first and second ends. One of the ends of the article is disposed within the distal end and is peripherally sealed to the interior of the sleeve.

2 Claims, 1 Drawing Sheet

FIG. 1
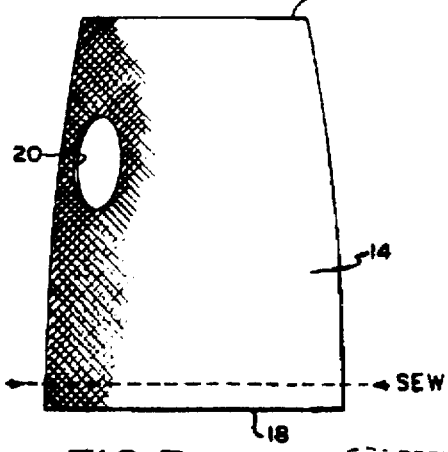
FIG. 2
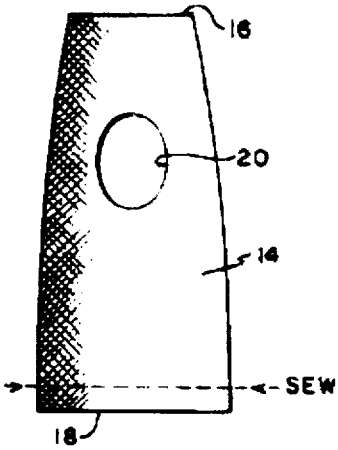
FIG. 3
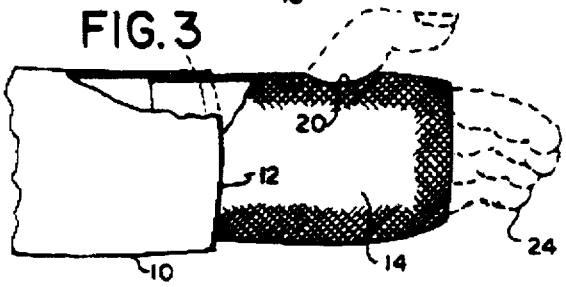
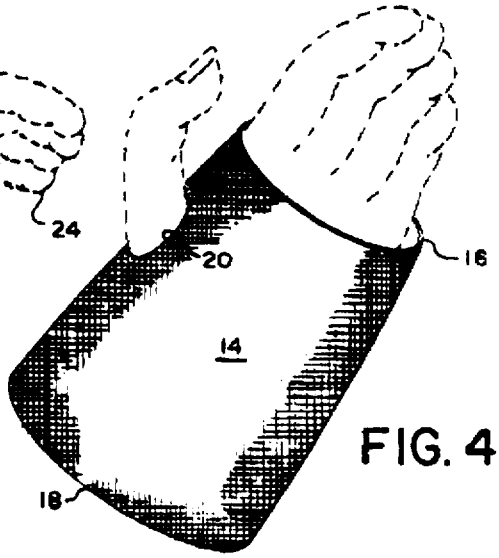
FIG. 4
FIG. 5
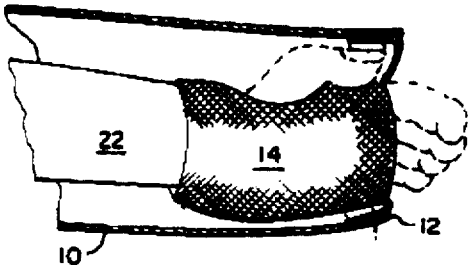
FIG. 6
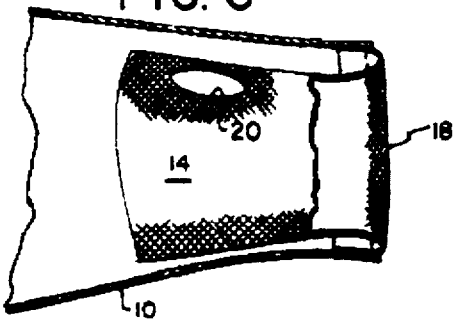
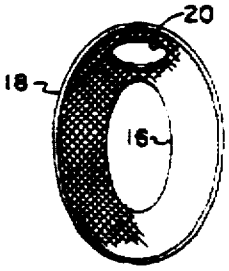
FIG. 7

GARMENT SLEEVE WITH PROTECTIVE INSERT IN DISTAL END

BACKGROUND OF THE INVENTION

The prior art, as disclosed for example in U.S. Pat. No. 5,001,785, shows a hospital garment having a fabric shield disposed within the cuff of the distal end of a sleeve for providing such a seal. This garment provides no protection for a hand extending beyond the cuff. In addtion, the prior art, as dislcosed for example in U.S. Pat. No. 5,572,743, shows a surgical garment having sleeves with stiffener rings at distal ends. The user must utilize separately attached gloves which are then supported in position by such rings.

SUMMARY OF THE INVENTION

In contradistinction, it is an object of the present invention to provide a garment sleeve which provides both sealing and palm protection simultaneously without use of separately attached hand protection.

It is another object to provide a garment sleeve adapted to receive the arm and hand of a user and so constructed that the palm of the user is protected, with finger movement unrestricted, as the hand extends out of the distal end of the sleeve and at the same time the distal end is sealed against entry of wind, air, rain and the like.

These and other objects and advantages of the invention will either be explained or will become apparent hereinafter.

In accordance with the principles of the invention, a relatively small hollow flexible article having opposite open ends is disposed within the open distal end of a relatively large garment sleeve adapted to receive an arm and hand of a user. One end is peripherally sealed to the inside of the sleeve. The article has a thumb receiving opening therein disposed between its opposite open ends. Before the sleeve is put into use, the end of the article opposite the sealed end extends backward within the sleeve away from the distal end and toward the proximate end. The article is then in its retracted position and is concealed within the sleeve.

When a user places an arm and hand within the sleeve and extends the hand through the distal end, the thumb of the user engages the thumb opening and the hand extends beyond the distal end with the position of the article reversed into its extended position at which the end of the article opposite the sealed end covers and protects the palm of the user, with finger movement unrestricted. When the user retracts his hand and arm, the article is returned to its retracted end.

The user can manually withdraw the thumb while the hand is extended and roll the article rearward within the distal end of the sleeve if the palm protection is to be removed.

The invention is explained in more detail with reference to the accompanying drawings and the detailed description which follows.

BRIEF DESCRIPTION OF THE DRAWINGS

FIG. 1 is a side view of the article before being inserted in the sleeve.

FIG. 2 is a front view of the article shown in FIG. 1.

FIG. 3 is a detail view of the sleeve with the article secured thereo and showing the user's hand extended and palm protected with the article in extended position.

FIG. 4 is an enlarged detail view showing the hand and article position of FIG. 3.

FIG. 5 is a detail view similar to FIG. 3 but showing the article in retracted position with the hand just beginning to extend beyond the distal end of the sleeve.

FIG. 6 is a cross sectional side view of the sleeve with the article in retracted position.

FIG. 7 is a front end view of the distal end of the sleeve with the article in position as shown in FIG. 6.

DETAILED DESCRIPTION OF PREFERRED EMBODIMENT

Referring now to FIGS. 1–7, there is shown a garment sleeve 10 of conventional clothing material having an open distal end 12. A hollow thin flexible article 14 of conventional clothing material has two opposite open ends 16 and 18. End 18 is somewhat larger in diameter than end 16. Article 14 has a small elongated thumb receiving hole 20 disposed between ends 16 and 18. The article end 18 is peripherally secured to the inside of the sleeve by sewing or the like adjacent the distal end 12. The article has a retracted position at which the entire article is concealed within the sleeve with end 16 extending away from the distal end toward the proximate end, that is the end of the sleeve secured to the garment.

When a user inserts an arm 22 and hand 24 in the sleeve, the thumb engages the hole 20 and the article is reversed in extended position with end 16 extending outwardly from the distal end. The article extends out of the sleeve, protecting the palm of the hand while not restricting finger movement. End 16 is somewhat smaller than end 18 in order to provide a relatively tight engagement for the palm.

When the user removes the arm and hand, as the hand is withdrawn, the article is pulled back into the sleeve into its retracted position.

Since garments of this type can be worn by adults and children of different ages and sizes and dimensions will vary over a wide range, the size and dimensions of the article used will also vary over a wide range. The length of the article is of course much smaller than the length of the sleeve, and a typical article length of about seven inches has been found to be satisfactory for use in adult garments. Similarly, a thumb opening length of about two inches and a width of about three quarters of an inch has been found to be satisfactory when the article is used in adult garments.

While the invention has been described with particular reference to the drawings and preferred embodiment, the protection solicited is to be limited only by the terms of the claims which follow.

What is claimed is:

1. A garment having a sleeve with sufficient length as to cover the wearer's entire arm to about the wrist, further having an interior side and an exterior side and an opening at the distal end;

a hollow flexible article having a first end attached to the interior of the sleeve about the periphery of the distal end and a second end extending outwardly from said sleeve and having sufficient length to cover no more than the palm area of a wearer's hand and allowing the fingers free unrestricted movement;

said hollow flexible member further having an elongated opening on a thumb side for receiving the thumb of the wearer, said elongated opening being spaced from said second end thus allowing the hollow flexible article to cover a palm area of the wearer when the thumb is inserted through said elongated opening;

the hollow flexible article is extended from the distal end of the sleeve when the garment is in use and is retracted completely into the sleeve when the hand is withdrawn from the garment allowing said article to be retained within the sleeve, giving the garment a conventional appearance.

2. The garment of claim 1, wherein the hollow flexible article is turned inside out when said article is retracted completely into said sleeve.

* * * * *